United States Patent [19]

Isbell et al.

[11] 4,379,208

[45] Apr. 5, 1983

[54] AM STEREO RECEIVER LOGIC

[75] Inventors: Tim D. Isbell; Don R. Sauer, both of San Jose, Calif.

[73] Assignee: National Semiconductor Corporation, Santa Clara, Calif.

[21] Appl. No.: 206,336

[22] Filed: Nov. 13, 1980

[51] Int. Cl.[3] ..... H04H 5/00

[52] U.S. Cl. ..... 179/1 GS; 455/194

[58] Field of Search ..... 179/1 GM, 1 GN, 1 GS; 455/194

[56] References Cited

U.S. PATENT DOCUMENTS 4,192,968 3/1980 Hilbert et al. ..... 179/1 GS 4,332,978 6/1982 Streeter ..... 179/1 GS

*Primary Examiner*—A. D. Pellinen

*Attorney, Agent, or Firm*—Gail W. Woodward; Paul J. Winters; Neil B. Schulte

[57] ABSTRACT

In an AM stereo radio receiver, a pilot signal is recovered from the phase modulated channel. The pilot signal is sensed by means of a bandpass filter tuned to the subaudible signal frequency and is used to operate a detector-switching amplifier combination. The switching amplifier actuates a visual indicator which shows the presence of a stereo broadcast. The receiver is provided with an electronic blend function that operates in response to the pilot signal and an excess phase signal that is present when the receiver is mistuned. OR Logic, which responds to either mistuning or a lack of stereo pilot signal, switches the receiver to monaural response. If desired, further OR Logic can include response to weak signals, in which case an improvement in signal to noise ratio is achieved.

4 Claims, 3 Drawing Figures

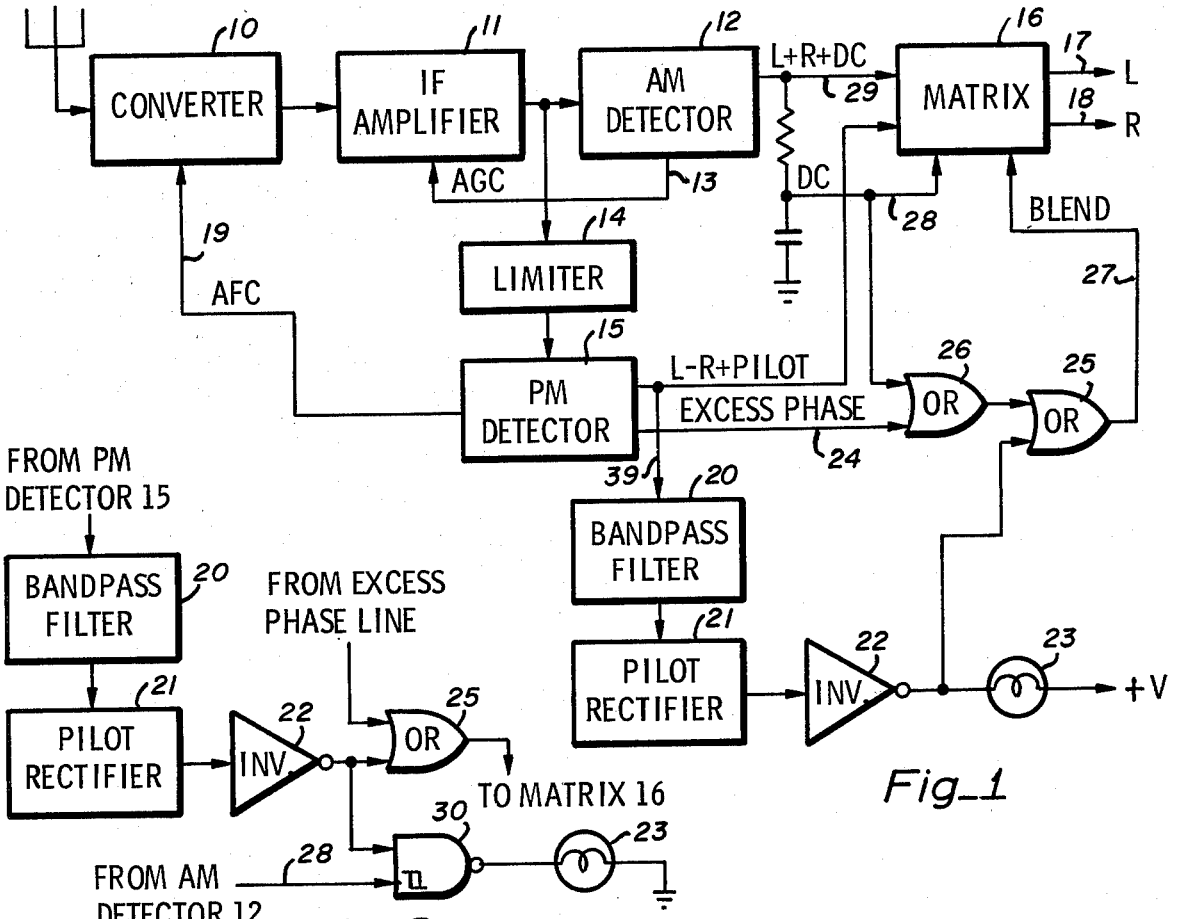
Fig_1
Fig_2
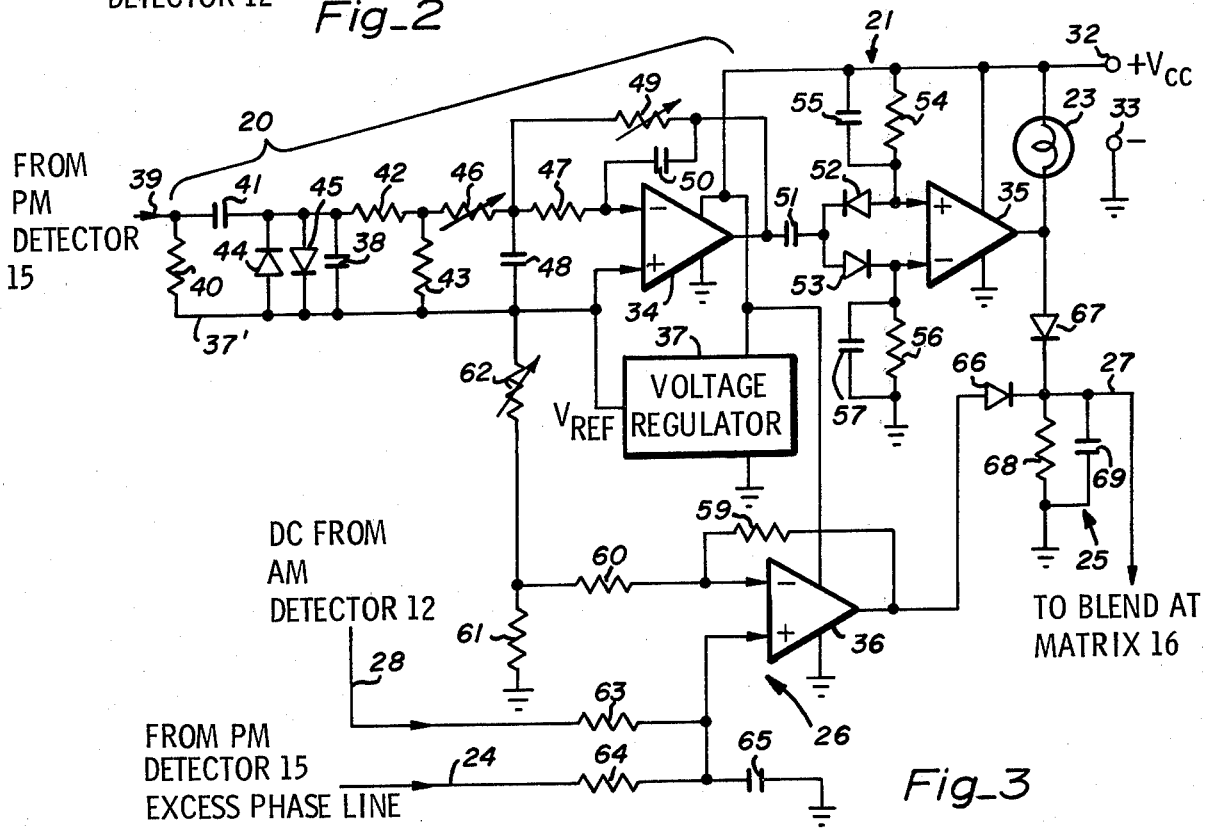
Fig_3

AM STEREO RECEIVER LOGIC

BACKGROUND OF THE INVENTION

The invention relates to AM stereo radio broadcast receivers and is particularly directed to a receiver using the Magnavox system recently announced as one of the systems of choice by the Federal Communications Commission. In this system, the conventional amplitude modulated (AM) radio channel carries the L+R stereo signal so that a conventional monaural radio receives a compatible signal. The L−R stereo signal is transmitted as a phase modulation (PM) of the carrier. A subaudible pilot tone also phase modulates the carrier and its phase modulation is substantially greater than that of the L-R component. Since the conventional radio will not respond to the PM, it will not be affected, thereby. However, if a limiter and detector are added to a conventional radio, the AM will be ignored in the added circuit and the PM can be recovered. Therefore, the L−R information and pilot signal can be separately recovered. It is then only necessary to matrix the two channels to recover the stereo signals for reproduction in a stereo audio system. While the circuits disclosed herein are intended for use with the proposed Magnavox system, it is to be understood that the functions performed can be used with other proposed AM stereo systems.

A copending patent application Ser. No. 197,294 filed Oct. 15, 1980, by Don R. Sauer, is titled AM STEREO PHASE MODULATION DECODER and is assigned to the assignee of the present invention. A PM decoder is disclosed for use with the Magnavox system receiver.

A copending patent application Ser. No. 187,006 filed Sept. 15, 1980, by Don R. Sauer, is titled FULL WAVE AMPLITUDE MODULATION DETECTOR CIRCUIT and is assigned to the assignee of the present invention. It discloses a detector circuit primarily intended for use in the AM portion of AM stereo receivers and has applications to the present invention as will be described hereinafter.

A copending patent application Ser. No. 200,636 filed Oct. 27, 1980, by Don R. Sauer, is titled AM STEREO RECEIVER SEPARATION CONTROL and is assigned to the assignee of the present invention. Means are disclosed for causing the L−R signal in an AM stereo receiver to track the amplitude of the L+R signal. When the two are matrixed together good L and R separation is obtained even for variable level signals. Also means for electronic blending of L and R is disclosed.

The above three patent applications are incorporated herein by reference.

SUMMARY OF THE INVENTION

It is an object of the invention to provide an AM stereo pilot signal indicator in combination with an automatic blend control responsive to the pilot signal and receiver mistuning.

It is a still further object of the invention to provide a logic controlled stereo blend in an AM stereo receiver in which blending is a function of loss of pilot signal, receiver mistuning, or an excessively weak received signal.

It is a still further object of the invention to automatically blend the two channels in an AM stereo radio receiver output in response to pilot signal loss or mistuning or excessively weak received signal and in which the stereo indicator is provided with a hysteresis response to avoid flickering.

These and other objects are achieved as follows. In an AM stereo receiver, a bandpass amplifier is coupled to the PM detector output with a response tuned to the pilot signal frequency. The bandpass amplifier is followed by a peak detector having a relatively long time constant load directly coupled to a switching amplifier. The switching amplifier output is low when the pilot signal is present and high when it is absent. The switching has a visual indicator coupled to its output to indicate the presence of the pilot signal. The amplifier output is also coupled to an OR gate that has a second input coupled to the excess phase output of the receiver PM detector. This excess phase is high when the receiver is mistuned, but low when it is on tune. The OR gate output is coupled to the blend circuit of the receiver so that when the receiver is mistuned or the stereo pilot signal absent the stereo is blended or muted. If desired, a third OR gate function can be added and coupled to the DC output of the AM detector so that blending also occurs for weak signals so as to improve the signal to noise ratio of weak signals.

BRIEF DESCRIPTION OF THE DRAWING

FIG. 1 is a block diagram of an AM stereo receiver showing the logic functions.

FIG. 2 is a block diagram of an alternative stereo pilot indicator circuit.

FIG. 3 is a schematic diagram of the logic circuitry of FIG. 1.

DESCRIPTION OF THE INVENTION

FIG. 1 is a block diagram of an AM stereo radio receiver showing the stereo logic action. Converter 10, if amplifier 11 and detector 12 comprise the conventional AM radio receiver elements that reproduce the L+R signal on line 29. Detector 12 supplies an AGG voltage on line 13 for controlling the gain of IF amplifier 11 (and possibly converter 10 along with any RF amplifier stages if any are used).

IF amplifier 11 also drives limiter 14 which in turn drives PM detector 15 to generate the L−R stereo information on line 39. The stereo pilot signal, which is a 5 Hz signal in the proposed Magnavox system, is also available on line 39. The L+R and L−R signals are combined in matrix 16 to produce the L and R signals available at output terminals 17 and 18, which can then be coupled to a conventional stereo amplifier and speaker system (not shown). If desired, PM detector 15 can supply an AFC signal on line 19 to converter 10.

The output of PM detector 15, on line 39, consists of the L−R+pilot signal information. Bandpass filter 20 is tuned to pass only the pilot signal which is sensed by rectifier 21 the output of which is high in the presence of the pilot. Inverter 22 operates pilot lamp 23 which could be an incandescent lamp, light emitting diode (LED) or any other form of visual indicator. When the output of inverter 22 is low, due to the presence of the rectified pilot signal, indicator 23 will be turned on.

The actual logic circuitry involves two cascaded two input OR gates 25 and 26. The output of OR gate 26 operates the matrix 16 blend port via line 27. The function of this port is fully described in copending application Ser. No. 200,636 filed Oct. 27, 1980. When line 27 is low, matrix 16 is fully operative so as to reproduce the L and R signals. When line 27 goes high matrix 16 causes L+R signals to appear at terminals 17 and 18 so that all stereo presence is eliminated or muted. This has the effect of improving the signal to noise ratio in the received signal.

OR gate 25 has its two inputs coupled respectively to OR gate 26 and indicator 23. The two inputs to OR gate 26 are coupled to the excess phase output line 24 and line 28, which is the D-C output of detector 12. The excess phase signal is described, in copending application Ser. No. 187,007 filed 9/15/80, as being low until the receiver is mistuned in which case it goes high. As shown in copending application Ser. No. 187,006 filed 9/15/80, the D-C output of detector 12 is high when no signal is present and goes low with the presence of a signal.

From the above, it can be seen that if the receiver is mistuned excessively or if the received signal is lost (or drops below some predetermined threshold value), the output of OR gate 26 will go high. This via OR gate 25 will drive line 27 high and thereby mute the stereo output. Thus, if the receiver is mistuned or the received signal too weak, the stereo is muted so as to automatically improve the receiver's signal to noise ratio. The same muting action occurs in the absence of the stereo pilot signal.

On the other hand, if the pilot signal is present and if the D-C output of detector 12 is low and if there is no excess phase output from PM detector 15, line 27 will be low and there is full stereo operation. Also, indicator 23 will show the pilot signal presence.

If desired, the signal level response can be omitted by removing OR gate 26 and running the excess phase signal line 24 directly to OR gate 25.

FIG. 2 is a block diagram of an alternative logic arrangement. OR gate 25 operates matrix 16 and has one input driven by inverter 22 as is the case in FIG. 1. The other input is from the excess phase line 24. The major difference lies in NAND gate 30, the output of which operates indicator 23. One input to NAND gate 30 is taken from inverter 22 and the other input is taken from line 28. Desirably the input coupled to line 28 has hysteresis as shown by the symbol. This means that when the output of inverter 22 is low (due to the presence of stereo pilot) and the D-C output of detector 12 on line 28 drops below a first threshold value, the output of NAND gate 30 will go high thus energizing indicator 23. However, if the received signal strength drops and the D-C signal on line 28 goes up, it will have to exceed a second higher threshold to cause NAND gate 30 to switch its output low. This hysteresis has the effect of making indicator 23 relatively insensitive to signal fluctuations that could cause the indicator to flicker. However, for large changes that exceed the hysteresis range, the indicator will operate normally as described above.

FIG. 3 is a schematic diagram showing how the FIG. 1 block diagram can be implemented. The circuit is operated from a power supply coupled between $+V_{CC}$ terminal 32 and ground terminal 33.

Three differential op-amps 34–36 provide the required gain functions. Voltage regulator 37 provides a regulated source of $V_{REF}$ on line 37'. The signal output from PM detector 15 on line 39 is coupled to the input. Resistor 40 develops the signal from PM detector 15 which include the stereo L−R+pilot information. The bandpass filter action, shown as 20 in FIG. 1, is accomplished using a cascade of two bandpass filters operating as follows: The first bandpass filter comprises a high pass element made up of capacitor 41 and resistors 42 and 43. A low pass element is made up of resistor 40 and capacitor 38. These elements are selected to provide a 5 Hz center frequency and provide a relatively low Q filter action.

Diodes 44 and 45 act as limiters so that the 5 Hz component (or pilot signal) from PM detector 15 is clipped. This ensures that any noise spikes from PM detector 15 are also clipped to the same level. This is important because the signal level at the pilot frequency is relatively low and could be swamped by larger noise components. Due to the limiter action, the noise spikes cannot exceed the desired signal value.

Resistors 42 and 43 divide the signal and couple it to a second bandpass filter comprising op-amp 34 in conjunction with resistors 46, 47, and 49 and capacitors 48 and 50. These parts form a well known narrow bandpass filter. Resistor 49 is made variable to set the center frequency of the bandpass and resistor 46 is made variable to adjust the effective Q of the bandpass characteristic.

Capacitor 51 couples the output of op-amp 34 to diodes 52 and 53 which act as peak rectifiers for the pilot signal to comprise rectifier 21 of FIG. 1. Op-amp 35 provides the action of inverter 22 of FIG. 1. Resistor 54 and capacitor 55 act as the load for diode 52 while resistor 56 and capacitor 57 act as the load for diode 53. In the absence of any signal current will flow from the +V line through resistor 54, diodes 52 and 53 and resistor 56. This current forward biases diodes 52 and 53 so that they impose a positive potential on the noninverting relative to the inverting inputs on op amp 35. Thus, the output will be high and indicator 23 will be off.

When a pilot signal is applied by way of capacitor 51, both diodes will start to rectify and their loads will charge to the input signal peak value. It can be seen that diode 52 will drive the noninverting input negative while diode 53 will drive the inverting input positive. This action will overcome the above described no signal bias and in sufficient amount will drive the output of op-amp 35 low, so as to turn indicator 23 on.

Op-amp 36 has its output coupled back to its inverting input, using resistors 59 and 60, so as to establish a controlled gain. Resistors 61 and 62 form a voltage divider to set the inverting input level at slightly below $V_{REF}$. The noninverting input is returned via resistor 63 to the D-C output of detector 12 on line 28 and via resistor 64 to the excess phase output of PM detector 15 on line 24. Capacitor 65 acts as an AC bypass at the juncture of resistors 63 and 64.

As explained in connection with FIG. 1, under normal conditions, the excess phase line 24 is normally low or close to zero. With a strong radio signal, line 28 is also low or close to zero. For these conditions the output of op-amp 36 will be low (because the inverting input is high or close to $V_{REF}$). If either the excess phase line 24 or detector output line 28 goes high, the output of op-amp 36 will go high. Thus, op-amp 36 in combination with resistors 63 and 64 forms OR gate 26 of FIG. 1.

Diodes 66 and 67 operate together to form OR gate 25. Their juncture is normally pulled low by the action of resistor 68, which is bypassed for AC by capacitor 69. If the outputs of either of op-amps 35 or 36 go high, by virture of their input states, one or both of diodes 66 or 67 will conduct and pull their juncture high. This will mute the stereo at matrix 16 via line 27.

EXAMPLE

The elements of the invention were assembled in discrete component style for association with an integrated circuit designated the LM1981. In this device, designed to operate at a nominal nine volts, $V_{REF}$ is 4.2 volts available at pin 19. The blend port is available at pin 11, the AM detector output at pin 4 and the excess phase output at pin 12. The device requires a 200 mv. of IF input at pin 1. The following parts were employed.

| Part | Value | Units |
|---|---|---|
| Op-amps 34, 35, 36 | LM324 | 3 sections of a quad op-amp |
| Capacitor 38 | 0.33 | microfarads |
| Resistor 40 | 200K | ohms |
| Capacitor 41 | 4 | microfarads |
| Resistor 42 | 100K | ohms |
| Resistor 43 | 10K | ohms |
| Diodes 44 and 45 | 1N914 | |
| Rheostat 46 | 20K | ohms |
| Resistor 47 | 2 meg | ohms |
| Capacitor 48 | 4.7 | microfarads (Tantalum) |
| Rheostat 49 | 1 meg | ohms |
| Capacitor 50 | 300 | picofarads |
| Capacitor 51 | 4 | microfarads |
| Diodes 52 and 53 | IN914 | |
| Resistor 54 | 10 meg | ohms |
| Capacitor 55 | 0.1 | microfarad |
| Resistor 56 | 10 meg | ohms |
| Capacitor 57 | 0.1 | microfarad |
| Resistor 59 | 100K | ohms |
| Resistor 60 | 20K | ohms |
| Resistor 61 | 5K | ohms |
| Rheostat 62 | 1K | ohms |
| Resistors 63 and 64 | 1 meg | ohms |
| Capacitor 65 | 0.1 | microfarad |
| Diodes 66 and 67 | IN914 | |
| Resistor 68 | 50K | ohms |
| Capacitor 69 | 100 | microfarads |

The circuit was connected to a conventional AM radio receiver. The standards associated with the Magnavox AM stereo proposal were employed, and in which the pilot frequency was 5 Hz. The indicator 23 responded to the 5 Hz of the carrier being received. The stereo blend action operated automatically when the receiver was mistuned in excess of about ±2 KHz or when the carrier signal strength fell below a predetermined value that could be varied with rheostat 62. At full blend the receiver signal to noise ratio was improved by about 3 db.

The invention has been described and an operating example set forth. When a person skilled in the art reads the foregoing, there are alternatives and equivalents within the spirit and intent of the invention that will become apparent. Accordingly, it is intended that the scope of the invention be limited only by the following claims.

We claim:

1. A logic circuit for operating an AM stereo radio receiver, said receiver including an envelope detector which provides an L+R signal along with a DC potential, a phase modulation decoder which provides an L−R signal along with a stereo pilot signal and an excess phase potential which appears when said receiver is mistuned, and a matrix which combines said L+R and said L−R signals to produce L and R signals for stereo sound reproduction, said matrix including electronic means for blending said L and R signals thereby to mute said stereo, said logic circuit comprising:

means for visually indicating the presence of a stereo signal in said receiver;

means coupled to said phase modulation decoder output for extracting said stereo pilot signal;

means for actuating said visually indicating means in response to said stereo pilot signal; and an OR gate having a first input coupled to said means for extracting said pilot signal and a second input coupled to said excess phase potential, whereby said receiver operates in a monaural mode when either mistuned or in the absence of said stereo pilot signal.

2. The logic circuit of claim 1 wherein said DC potential is coupled to a third input on said OR gate means.

3. The logic circuit of claim 2, wherein said visually indicating means is operated from a NAND gate which has a first input coupled to said means for extracting said stereo pilot signal and a second input coupled to said DC potential.

4. The logic circuit of claim 3, wherein said second NAND gate input includes hysteresis means whereby said visually indicating means does not fluctuate on weak signals.

* * * * *